United States Patent [19]

Kline, Jr. et al.

[11] 3,935,676

[45] Feb. 3, 1976

[54] TIRE TREAD GRINDING

[75] Inventors: Crandall R. Kline, Jr.; Leonard A. Vandale, both of Akron, Ohio

[73] Assignee: The Goodyear Tire & Rubber Company, Akron, Ohio

[22] Filed: Mar. 24, 1975

[21] Appl. No.: 561,138

[52] U.S. Cl. ..... 51/106 R; 51/165 R; 51/165.77

[51] Int. Cl.[2] ..... B24B 5/00; B24B 49/08

[58] Field of Search. 51/104, 106 R, 165 R, 165.74, 51/165.75, 165.76, 165.77, 165.91, 165.92; 157/13

[56] References Cited

UNITED STATES PATENTS

| | | | |
|---|---|---|---|
| 3,553,903 | 7/1967 | Christie | 51/106 R |
| 3,574,973 | 4/1971 | Rader | 51/106 R |
| 3,681,877 | 8/1972 | Shively | 51/106 R |
| 3,841,033 | 10/1974 | Appleby | 51/106 R |
| 3,848,369 | 11/1974 | Monajjem | 51/106 R |
| 3,866,360 | 2/1975 | Monajjem | 51/106 R |

*Primary Examiner*—Othell M. Simpson
*Attorney, Agent, or Firm*—F. W. Brunner; R. S. Washburn

[57] ABSTRACT

In apparatus for grinding arc portions of parts of the width of a tire tread, apparatus for controlling tilt of the grinding wheels relative to the tire rotation plane makes use of three paddles having arc contours for lengthened contact with the circumference of the tire tread and means for adjusting the location of the contour relative to the tire and grinding wheel centers to accommodate differences in diameter of one tire from another.

The foregoing abstract is not to be taken as limiting the invention of this application, and in order to understand the full nature and extent of the technical disclosure of this application, reference must be made to the accompanying drawing and the following detailed description.

6 Claims, 4 Drawing Figures

TIRE TREAD GRINDING

This invention is related to grinding tires for vehicles, and particularly for grinding tires to remove small quantities of rubber from portions of the tread surface of such tires for corrective purposes.

It has become a common practice to mount and inflate tires for rotation and to grind certain portions of the tread surface thereof to diminish certain variations in the force response between the tire and a measuring wheel. To accomplish this, a grinding wheel is mounted usually on a mechanism capable of maneuvering the grinding wheel itself into an appropriate position with respect to the portions of the tread from which material is to be removed by grinding.

Because one tire differs from a succeeding tire in diameter and in tread profile arc by small amounts which are totally insignificant in the appearance or use of such tires, it is desirable to provide a mechanism responsive to the actual diameter and profile arc of the tire by which the operating position of the grinding wheel can be controlled. In other words, it is desirable to tell the grinding wheel where the surface of the tire is so that grinding can be effected accurately without either excessive over-travel or under-travel.

It is a primary object of the invention to provide an apparatus capable of locating a grinding wheel relative to the tread surface which is independent of surface irregularities in the tread of the tire.

To acquaint persons skilled in the art with the principles and practice of the invention, a best mode and presently preferred embodiment of the invention will be described by and in connection with the accompanying drawings in which.

Figure 1:
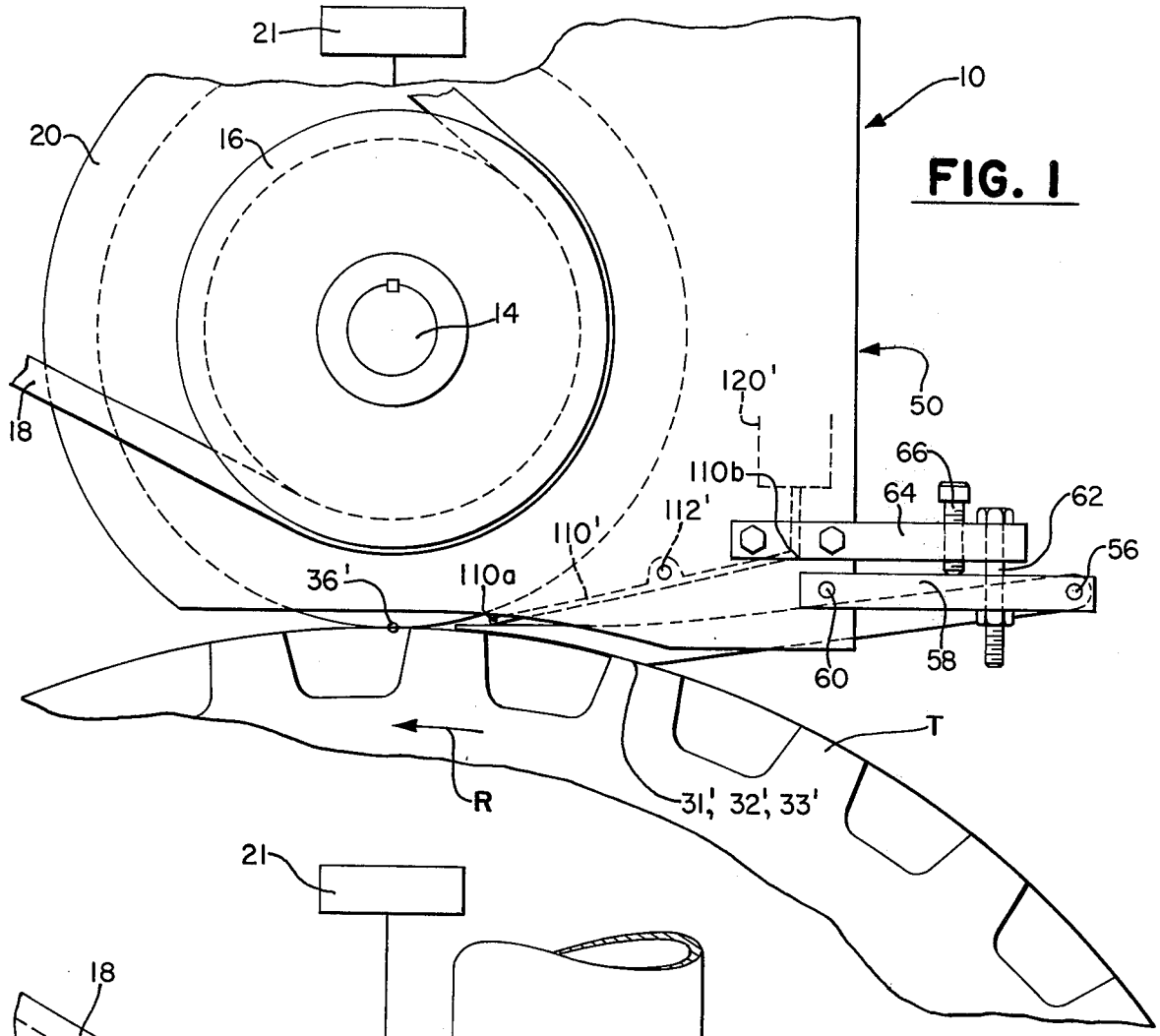
FIG. 1 is an axial end view of the grinding wheel together with a portion of a tire illustrating the mechanism of the invention in schematic form.

In FIG. 1 there is illustrated a simplified embodiment of the invention in an apparatus 10 for grinding arcuate portions of a part P of the width of the tread T of an inflated tire. Portions of the tread of the tire are ground by a grinding wheel 12 which is mounted for rotation about a center shaft 14 which carries a pulley 16 within the loop of a belt 18 by which the wheel is driven. The tire is mounted and inflated upon a rotatable chuck (not shown) which rotates about the central rotational axis of the tire.

The grinding wheel assembly, which includes the wheel, its drive, and a guard-dust collector 20 surrounding the wheel, is mounted on an arm or an equivalent (not shown) by which the wheel can be moved toward and away from the tire by a first mechanism 21. A second mechanism 22, independent of the first mechanism, is operable to tilt the central shaft 14 of the grinding wheel, thereby changing the angle of the grinding wheel axis with respect to the tire rotational plane 25. This mechanism 22 operates to position the grinding surface of the grinding wheel relative to the slope of the part of the width of the tread to be ground in the reference plane defined by the two axes.

Figure 2:
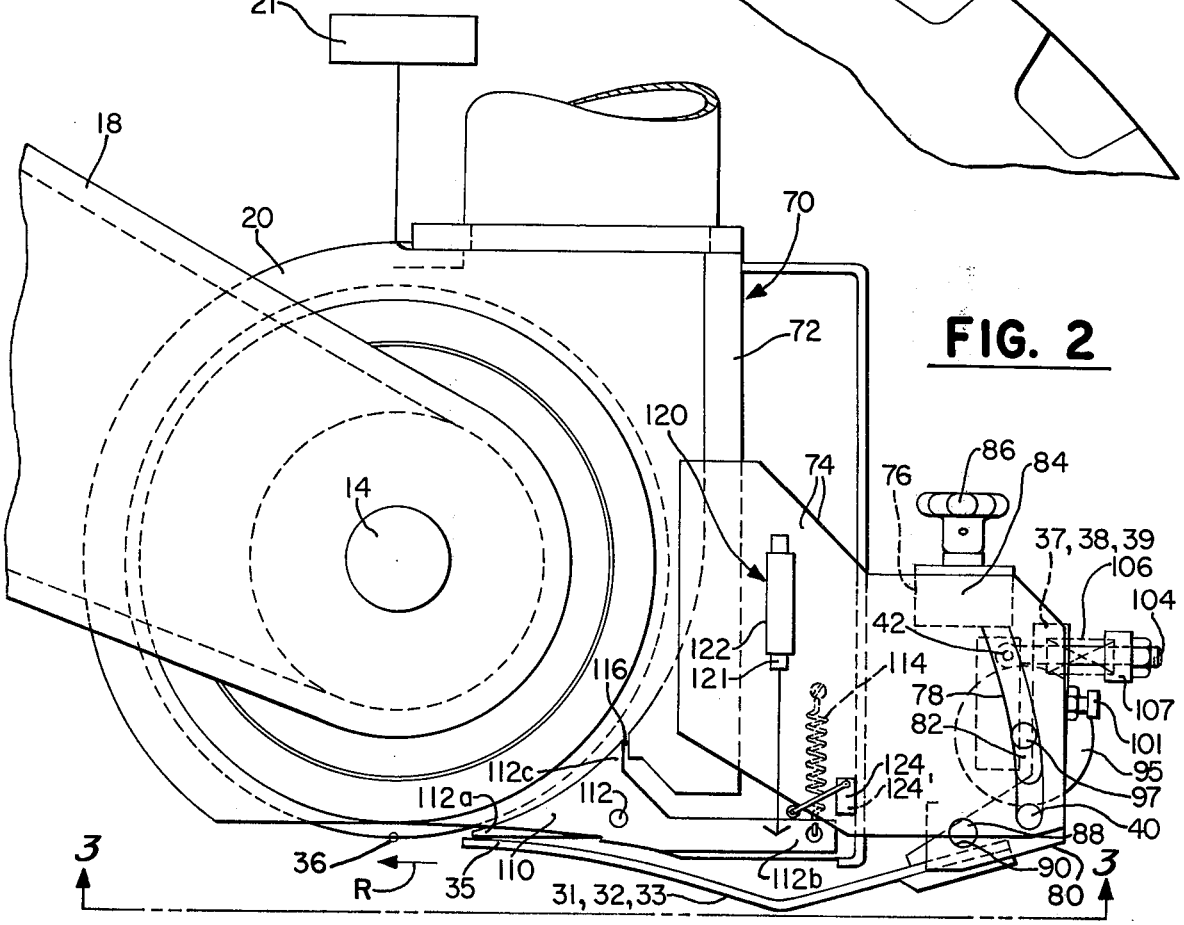
FIG. 2 is an axial end view of the grinding wheel together with an improved apparatus according to the invention.

The apparatus illustrated in FIG. 2 insofar as has been thus far described is identical in all respects to that of FIG. 1. Both of the apparatus to the extent so far described are in common use and thus outside the scope of the present invention.

Figure 3:
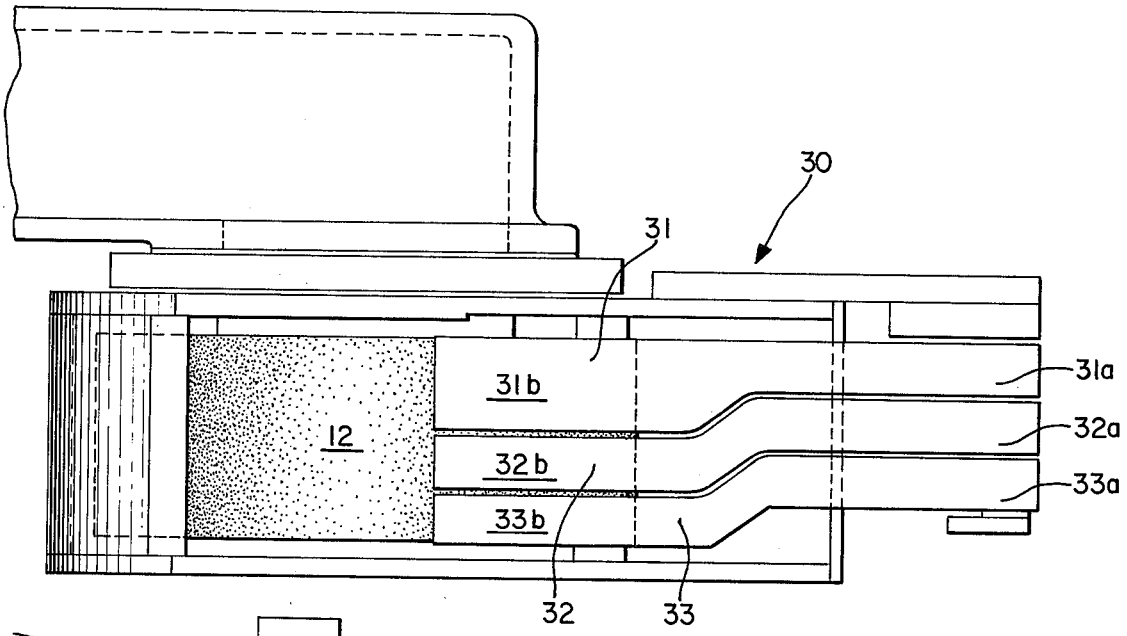
FIG. 3 is a view of the mechanism according to the invention taken on the lines 3—3 in FIG. 2.
Figure 4:
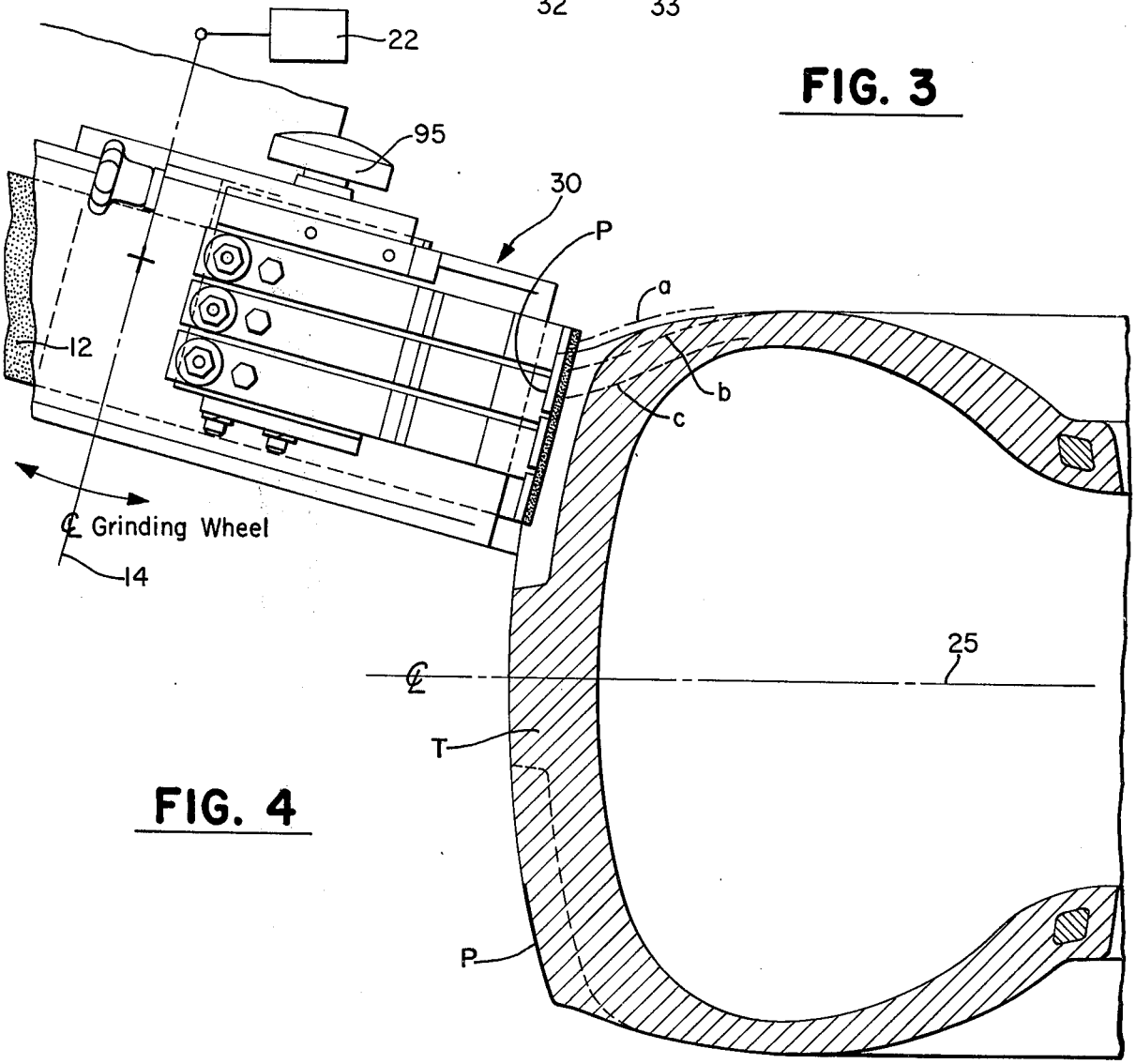
FIG. 4 is an elevation view in cross-section illustrating the apparatus of FIGS. 2 and 3 in operating position relative to a tire to be ground.

As illustrated in FIGS. 3 and 4, the mechanism 30 in accordance with the invention includes three paddles 31, 32, 33 arranged side by side and having together a total width about equal to the width of the grinding face of the grinding wheel. One (31) of the paddles is wider than the other two 32, 33, approximating one-half the face width of the grinding wheel 12. As may be observed in FIG. 4, this paddle can readily accommodate tires of differing tread width as represented by the phantom lines *a*, *b*, and *c* in the figure. In FIGS. 1 and 2, it will be seen that the paddles each have an arcuate surface contour 35 closely conforming to the circumference of the tread to be ground over a large arc extending from a line close to the bite or centerline 36 of grinding contact of the wheel and tire along the tire circumference in a direction opposite the normally preferred direction of rotation (arrow R). The length of the contour 35 of the paddle surface is in all cases great enough that any displacement of the paddle by the tire is independent of surface irregularity in the pattern of the tread, such as in tread patterns employed in mud or snow tires and the like. The arcuate surface contours 35 of the paddles are smooth and may optionally be treated to enhance their ability to glide smoothly on the tread surface during rotation of the tire.

Each paddle is bent, as best described by FIG. 2, at one end of the arcuate surface outwardly away from the position occupied by the tire and is attached to a pivot arm. For convenience in mounting, the paddles are offset in the manner best described by FIG. 3, the pivoted ends 31*a*, 32*a*, 33*a* being offset axially of the wheel 12 relative to the free ends 31*b*, 32*b*, 33*b*.

The three paddle pivot arms 37, 38, 39 are mounted side by side on a pivot shaft 40 about which the arms can oscillate such that the paddles can be displaced individually by their respective contacts with the tire as the grinding wheels move toward the tire even though the tilt angle of the shaft 14 does not accord with the slope of the part P as the wheel 12 approaches the tire. The pivot shaft 40 is mounted in a bracket 42 which permits the pivot shaft to be adjusted arcuately about the centerline 36 of tangency between the grinding wheel and the tire, the shaft 40 remaining parallel to the center shaft 14 of the grinding wheel, providing thereby means for controlling the conformity of the contours 35 with tires of differing diameters.

As seen in FIG. 1, a second, and simplified embodiment of the invention, illustrated therein, the mechanism 50 includes a plurality of paddles 31', 32', 33' alike in arrangement and function to the previously described paddles 31, 32, 33. Each of the paddles is pivotally mounted on a common pivot shaft 56 which is carried by the pivot shaft arm 58 which is itself pivotable about a pivot pin 60 fixed on a portion of the guard-dust collector 20. The pin 60 extends parallel to the axis of the shaft 14. To accommodate variations in the diameters of tires to be ground, the pivot shaft arm 58 can be adjusted to swing the pivot shaft 56 arcuately about the pin 60, and about the centerline of grinding contact 36', thus adjusting its position relative to both the tire rotation axis and the grinding wheel axis. The adjustment is accomplished by manipulating a through-bolt 62 disposed in collinear holes respectively extending through the pivot shaft arm 58 and through a bracket 64 secured immovably on the guard-dust collector. Adjustment of the distance between the bolt head and the nut suffice to move the pivot shaft as required, by swinging the arm 58 toward or away from the bracket 64. A lock screw 66 threaded in the fixed bracket 64 serves to lock the position of the pivot shaft arm in its adjusted position.

The position of each paddle as displaced by the tire surface is sensed by a feeler 110' mounted intermediate its length on a pivot pin 112' extending parallel to the grinding wheel shaft 14. The end 110*a* of the feeler is urged into continuing contact with the respectively associated paddle by spring means (not illustrated). The opposite end 110*b* of the feeler associated with the paddle 31 is operably engaged with the armature of a differential transformer 120' the output of which is communicated to conventional control means (not shown) operable to control the aforesaid first mechanism 21, and thereby the radial movement of the grinding wheel shaft.

In FIG. 2, a mounting frame 70 of the mechanism includes a plate 72 fastened on the guard 20 of the grinding wheel, a pair of mounting plates 74 extending outwardly normal to the grinding wheel axis which are spaced apart by a spreader bar 76 to form an open box-like structure. One of the mounting plates is provided with a curved slot or channel 78 having an arc approximately concentric with the centerline 36 of the grinding bite. A pivot slide bracket 80 in which the pivot shaft 40 is fixed has an arcuate tongue 82 which is held slidably in the channel 78 so that it can be moved along the channel to reposition the pivot shaft along an arc concentric about the centerline 36. Movement of the slide bracket 80 is provided by an adjustment screw 84 with a hand knob 86 which is mounted rotatably in the spreader bar 76 and is threaded to an adjustment nut 88 having a cylindrical exterior slidably fitting a bore 90 in the pivot bracket such that by manipulation of the hand knob the pivot bracket and the pivot shaft carried therein is moved arcuately. A clamp knob 95 threaded on a stud 97 fixed on the pivot bracket 42 and extending through an arcuate slot in the side plate 74 is operable to secure the pivot bracket to the side plate to fix the adjusted position of the pivot shaft.

To limit the excursion of the paddles toward the space occupied by the tire, a conventional stop screw 101 is fixed in each pivot arm and adjustably engages the pivot bracket at the limit of the respective arm excursion.

To urge each paddle toward the space occupied by the tire, a stud 104 is fixed in the pivot bracket 42 and extends freely through a hole in the respective pivot arm. A spring 106 surrounding the stud and extending between the pivot arm and a spring retainer 107 adjustably fixed on the stud operates to urge the tip or free end of the associated paddle toward the tire.

In order to sense the displacements of the respective paddles 31, 32, 33 in response to their respective contacts with the tire to be ground, and thereby measure the tilting movement of the grinding wheel relative to the plane 25 and to the slope of the tread surface part P, a feeler 110 is associated respectively with each paddle. Each feeler is mounted on a pivot pin 112 extending parallel to the grinding wheel shaft 14 and fixed in the frame 70. One end 112*a* of the feeler is maintained in contact with the respectively associated paddle by a spring 114 fixed at one of its ends in the frame and attached at its opposite end to the opposite end 112*b* of the feeler. An extension 112*c* on each feeler cooperates with a stop provided by a surface 116 on the frame 70 to prevent inward excursion of the feeler and of the respective paddle toward the grinding wheel surface.

The two limit switches 124 mounted on the frame 70 are respectively actuated by the feelers 110 associated with the two paddles 32 and 33. The limit switch actuated by movement of the middle paddle 32 is connected to stop tilting of the grinding wheel with the grinding surface positioned with respect to the slope of the tread. The limit switch 124' associated with the paddle 33 is actuated by any excessive displacement of the paddle 33 to stop further inward movement of the grinding wheel.

The wider paddle 31, on radially inward movement of the grinding wheel, engages the tire first, before the other paddles, initiating the tilting movement. The arcuate extent of the paddles must be sufficient to bridge or span over at least one traction groove of the type and size characteristic of mud and snow tires. The differential transformer 120, its movable armature being operatively connected to the feeler 110 associated with the paddle 31, responds to displacement of the paddle 31 and its output controls the first mechanism 21 to move the grinding wheel radially toward and away from the tire. The length and width of the paddle 31 enable smooth response of the mechanism 21 to the demands for correction from the force variation measuring wheel.

The operation of the apparatus described will have become apparent from the description of the apparatus itself. The adjustment of the position of the pivot axis is best described as a trial and error adjustment. It has been found effective to adjust the hand knob 86 until the grinding runs most smoothly. The procedure will be apparent from the description in that the clamp knob 95 will be loosened and then the hand knob 86 adjusted so as to move the pivot shaft 40 closer to or farther from the tire to be ground while the tire is in motion until any apparent vibration disappears or is at least minimized. The clamp knob 95 is then tightened and further operation can proceed automatically in the grinding of the tire treads.

While certain representative embodiments and details have been shown for the purpose of illustrating the invention, it will be apparent to those skilled in the art that various changes and modifications may be made therein without departing from the spirit or scope of the invention.

What is claimed is:

1. In apparatus for grinding arc portions of a part of the width of the tread of an inflated tire wherein the apparatus includes means mounting the tire for rotation about a first axis, a grinding wheel operable to grind off material from the tread, a first mechanism for moving the grinding wheel toward and away from the tread, and a second mechanism for tilting the grinding wheel with respect to the plane of rotation of the tire to position the grinding surface of the wheel relative to the slope of said part in a plane defined by the tire axis and the grinding wheel axis, the improvement comprising a mechanism combining a plurality of paddles each having an arcuate surface engageable with an arcuate portion of the tread from and outwardly of a line parallel and close to said plane and spanning at least one traction groove for smooth sliding engagement with said tread during rotation of the tire, a pivot shaft having an axis parallel to the axis of the grinding wheel and carrying said plurality of paddles for arcuate displacement about the pivot shaft axis, a shaft mounting for adjustably fixing the location of the pivot shaft relative to the axis of the grinding wheel and to the tread, and displacement responsive mechanism responsive to displacement of at least one of said paddles about said pivot shaft for communicating to said first mechanism a control signal effective to control said moving of the grinding wheel toward and away from the tire.

2. An apparatus as claimed in claim 1, further comprising a plurality of feelers each having a free end disposed respectively to urge each of said paddles independently toward said tread, a pivot pin pivotally supporting said plurality of feelers and located in fixed relation to said grinding wheel, stop means limiting the excursion of each said feeler toward said wheel and a spring urging each said feeler toward the respectively associated paddle, such that each said free end continuously engages the associated paddle.

3. An apparatus as claimed in claim 2, wherein said displacement responsive mechanism comprises a linear differential transformer having an armature, said armature being operably connected to a respective one of said feelers.

4. An apparatus as claimed in claim 1, wherein said shaft mounting is movable along a circular arc having its center in said line, a frame member fixed relative to said grinding wheel and having an arcuate groove, an arcuate tongue on said shaft mounting, said tongue and said groove cooperating to guide said shaft mounting along said circular arc.

5. An apparatus as claimed in claim 4, further including an adjustment screw and nut cooperable to move said shaft mounting relatively of said frame.

6. An apparatus as claimed in claim 1, further comprising an arm carried on said shaft for pivotal movement thereabout, said arm having seating means for securing one of said paddles thereto, and having an extension, a spring biasing said extension toward said holding means and said one of the paddles toward said tire.

* * * * *